US008447197B2

(12) United States Patent
Yamazaki

(10) Patent No.: US 8,447,197 B2
(45) Date of Patent: May 21, 2013

(54) IMAGE FORMING APPARATUS

(75) Inventor: Hiroyuki Yamazaki, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 360 days.

(21) Appl. No.: 12/819,826

(22) Filed: Jun. 21, 2010

(65) Prior Publication Data

US 2010/0329710 A1 Dec. 30, 2010

(30) Foreign Application Priority Data

Jun. 24, 2009 (JP) ..... 2009-149806
May 20, 2010 (JP) ..... 2010-116395

(51) Int. Cl.
*G03G 15/00* (2006.01)

(52) U.S. Cl.
USPC ..... 399/49

(58) Field of Classification Search
USPC ..... 399/38, 46, 49, 60; 347/131, 132
See application file for complete search history.

(56) References Cited

U.S. PATENT DOCUMENTS

| | | | | |
|---|---|---|---|---|
| 7,054,568 | B2 * | 5/2006 | Mizes et al. | 399/49 |
| 7,120,369 | B2 * | 10/2006 | Hamby et al. | 399/49 |
| 7,382,387 | B2 * | 6/2008 | Ichikawa et al. | 347/131 |
| 2007/0120939 | A1 * | 5/2007 | Arai et al. | 347/132 |
| 2007/0236747 | A1 * | 10/2007 | Paul | 358/3.26 |
| 2009/0046325 | A1 * | 2/2009 | Paul et al. | 358/3.26 |

FOREIGN PATENT DOCUMENTS

| | | | |
|---|---|---|---|
| JP | 2005-010680 | A | 1/2005 |

* cited by examiner

*Primary Examiner* — Sandra Brase
(74) *Attorney, Agent, or Firm* — Canon USA Inc. IP Division

(57) ABSTRACT

An image forming apparatus, which appropriately performs a banding correction even if similar banding does not always occur at a same position of a recording medium, detects reflected light from a test patch image and obtains information on a density change caused by a periodically-uneven rotation of a rotation member, and performs a density correction at an arbitrary position of a print image based on the acquired information on the density change.

8 Claims, 19 Drawing Sheets

FIG. 9

| FREQUENCY (cycle/mm) | AMPLITUDE (m = 1～3) | PHASE (m = 1～3) |
|---|---|---|
| 1/Td | Ad_m | Pd_m |
| 1/Ti | Ai_m | Pi_m |
| 1/Ts | As_m | Ps_m |

IMAGE FORMING APPARATUS

BACKGROUND OF THE INVENTION

1. Field of the Invention

The present invention generally relates to image forming and, more particularly, to an image forming apparatus that forms an image based on image signals.

2. Description of the Related Art

Image forming apparatuses have become popular that adopt an electrophotographic type or an ink jet type. A certain level of image quality is required for such image forming apparatuses. One of various elements causing deterioration of the image quality is uneven density in a direction of conveying paper (a direction for sub-scanning paper), which is so-called banding. For example, when the image forming apparatus of the electrophotographic type is used, periodically-uneven rotation (periodical variation of rotation speed) of a photosensitive drum, a driving roller of an intermediate transfer belt, a development roller, or a gear generates the banding in a direction of sub-scanning the image.

More specifically, for example, if the uneven rotation of the photosensitive drum is generated, a position at which laser beams write the image is periodically changed.

Further, if the uneven rotation of the driving roller of the intermediate transfer belt is generated, a position onto which the image is transferred is periodically changed. Furthermore, if the uneven rotation of the development roller is generated, a state where the image is developed is periodically changed. These periodical changes appear as the banding on the image, and thus printing quality is deteriorated.

Having the issues described above as a background, for example, Japanese Patent Application Laid-Open No. 2005-010680 discusses a solution. More specifically, Japanese Patent Application Laid-Open No. 2005-010680 discusses a method for reading printing results with a scanner, measuring a strength of the banding, and then performing a correction at a position where the scanning line is written in the direction of sub-scanning the image, to cancel the printing results when the banding has a certain strength or more.

Japanese Patent Application Laid-Open No. 2005-010680 assumes that a similar kind of banding is always generated at any position of a recording medium where printing is performed. However, the similar kind of banding is not always generated at the same position of the recording medium. This is because, although the banding has a predetermined period, a phase of a density change generated at a leading end of the recording medium is not always constant, therefore the phase can be different every time the printing is performed. Thus, a technique discussed in Japanese Patent Application Laid-Open No. 2005-010680 may not be able to appropriately perform a banding correction.

SUMMARY OF THE INVENTION

According to an aspect of the present invention, an image forming apparatus includes an image forming unit including a rotation member configured to form an image, a detection image forming unit configured to have the image forming unit forma detection image, a detection unit configured to detect reflected light when the formed detection image is irradiated with light, an acquisition unit configured to acquire information on a density change that periodically changes in a sub-scanning direction of the detection image caused by rotation of the rotation member, from results detected by the detection unit, and a correction unit configured to correct an image density based on a reference state in the acquired information on the density change that periodically changes and information on a rotation amount of the rotation member from a reference timing corresponding to the reference state. With these characteristics, even if similar banding do not always occur at the same position of a recording medium, an appropriate banding correction can be performed.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 9 is a list of parameters acquired from results of detecting optical characteristics.

DESCRIPTION OF THE EMBODIMENTS

Various exemplary embodiments, features, and aspects of the invention will be described in detail below with reference to the drawings. The individual embodiments described below will be helpful in understanding a variety of concepts of the present invention from the generic to the more specific.

Further, the technical scope of the present invention is defined by the claims, and is not limited by the following individual embodiments.

[Cross-Sectional View of Printer]

Figure 1:
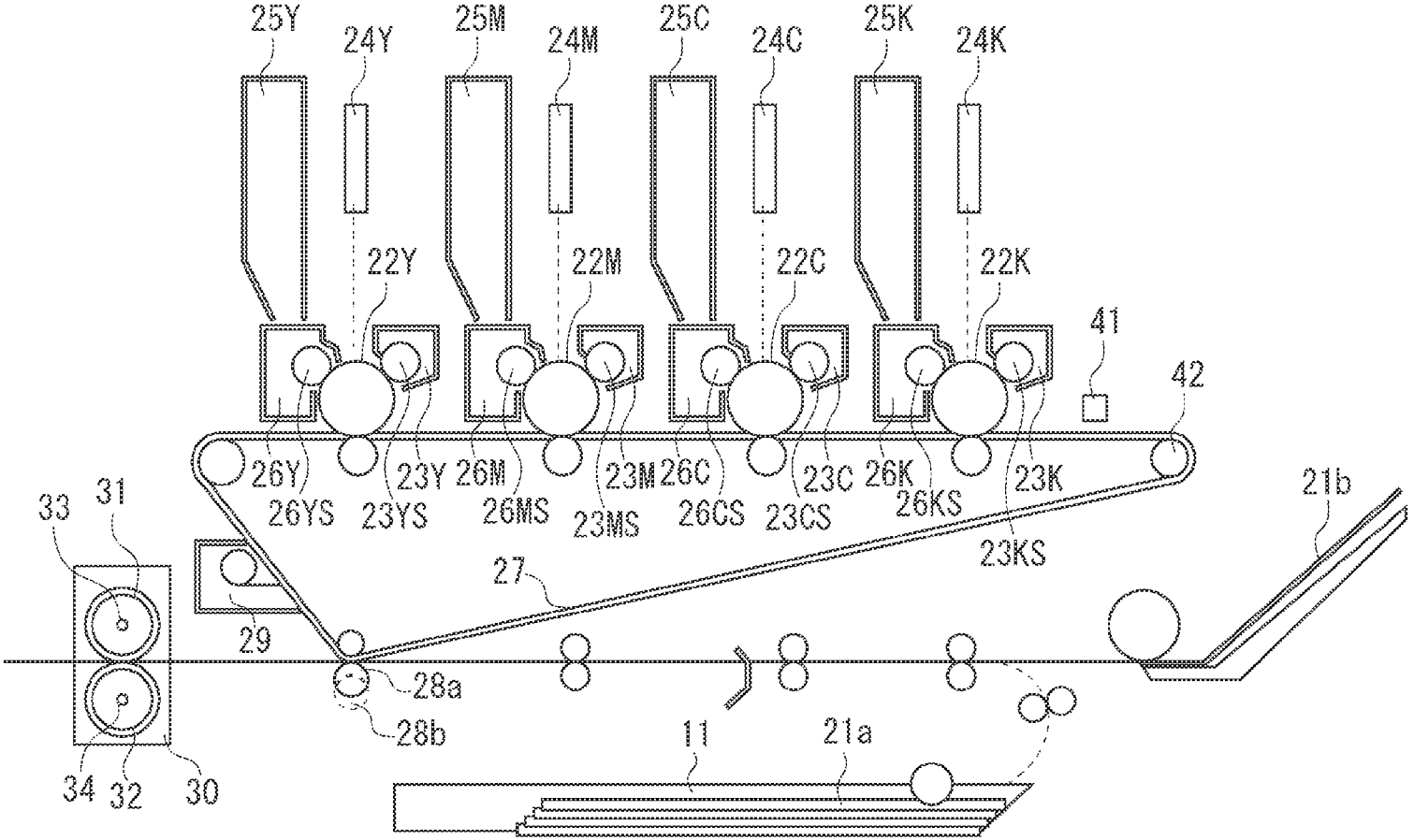
FIG. 1 is a vertical cross-sectional view illustrating an exemplary embodiment of a color image forming apparatus.

FIG. 1 is a vertical cross-sectional view illustrating an exemplary embodiment of a color image forming apparatus. Firstly, the color image forming apparatus forms an electrostatic latent image with exposure light emitted based on image information supplied by an image processing unit (not illustrated), and the electrostatic latent image is developed to form monochromatic toner images. The monochromatic toner images in respective colors are formed and overlapped with each other. The overlapped monochromatic toner images are transferred to a transfer material 11, and then a multi-color toner image is fixed thereon. Details are described below.

The transfer material 11 is fed from a paper feeding unit 21*a* or 21*b*. Photosensitive drums (photosensitive members) 22Y, 22M, 22C and 22K are each formed of an aluminum cylinder whose outer periphery is provided with an organic optical conductive layer. A driving force generated by a driving motor (not illustrated) is conveyed to rotate the photosensitive drums. Injecting chargers charge the photosensitive members.

Four injecting charges 23Y, 23M, 23C, and 23K correspond to yellow (Y), magneta (M), cyan (C), and black (K) respectively. Injecting charges are each provided with sleeves 23TS, 23MS, 23CS, and 23KS. Exposure light is emitted from scanning units 24Y, 24M, 24C, and 24K, to which surfaces of the photosensitive drums 22Y, 22M, 22C and 22K are selectively exposed to form the electrostatic latent image.

Development devices perform toner development with recording agent supplied from toner cartridges 25Y, 25M, 25C, and 25K, so that the electrostatic latent image becomes visible. Four development devices 26Y, 26M, 26C, and 26K correspond to yellow (Y), magenta (M), cyan (C), and black (K) respectively. Development devices are each provided with sleeves 26YS, 26MS, 26CS, and 26KS and detachably attached to the color image forming apparatus.

An intermediate transfer member 27 is in contact with the photosensitive drums 22Y, 22M, 22C and 22K, and is rotated by a driving roller of an intermediate transfer member 42 in a clockwise direction when a color image is formed. Along with rotations of the photosensitive drums 22Y, 22M, 22C and 22K, the intermediate transfer member 27 is rotated to transfer monochromatic images. A transfer roller described below contacts the intermediate transfer member 27, and holds and conveys the transfer material 11 so that the multi-color toner image on the intermediate transfer member 27 is transferred onto the transfer material 11.

The transfer roller abuts on the transfer material 11 at a position 28*a* while the multi-color toner image is transferred onto the transfer material 11, and separated away to a position of 28*b* after printing processing is performed. A fixing unit 30 melts and fixes the transferred, multi-color toner image while the transfer material 11 is transferred. As illustrated in FIG. 1, the fixing unit 30 includes a fixing roller 31 for heating the transfer material 11 and a pressing roller 32 for contacting and pressing the transfer material 11 to the fixing roller 31. The fixing roller 31 and the pressing roller 32 are formed in a hollow shape, and include heaters 33 and 34 therein.

More specifically, while the transfer material 11 retaining the multi-color toner image is conveyed by the fixing roller 31 and the pressing roller 32, the transfer material 11 is provided with heat and a pressing force to fix the toner on a surface thereof. After the toner image is fixed, the transfer material 11 is discharged to a paper discharge tray (not illustrated) by a discharging roller (not illustrated) and the image forming operation is ended. A cleaning unit 29 cleans the toner remaining on the intermediate transfer member 27. Discarded toner is stored in a cleaner container after the multi-color toner image in four colors formed on the intermediate transfer member 27 is transferred onto the transfer material 11.

A density sensor 41 is disposed facing the intermediate transfer member 27 in the image forming apparatus illustrated in FIG. 1, and measures a density (corresponding to reflection light) of a toner patch formed on a surface of the intermediate transfer member 27. When viewed from above, for example, a direction of conveying the transfer material or a direction of rotating the intermediate transfer material, which is orthogonal to a main-scanning direction, is hereafter referred to as a conveyance direction or a sub-scanning direction with respect to the main-scanning direction of the image. In addition, "patch"according to the exemplary embodiment, is used to detect density and can be referred to "detection image". For example, a patch 64 illustrated below in FIG. 3 and patches illustrated below in FIGS. 8 and 9 can each be referred to as a detection image.

[Block Diagram of Image Processing Unit]

Figure 2:
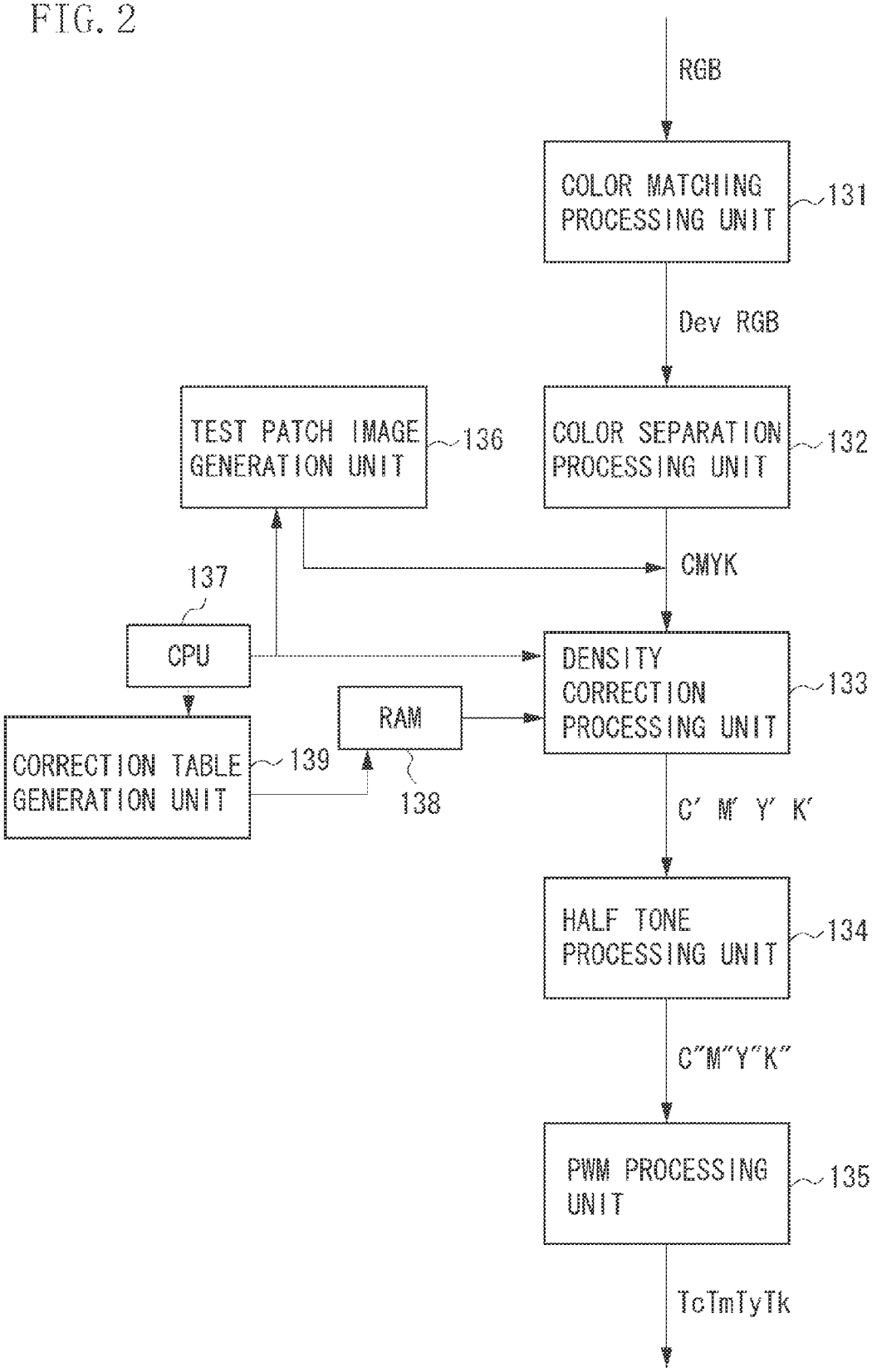
FIG. 2 is a block diagram illustrating an exemplary embodiment of an image processing unit.

FIG. 2 is a block diagram illustrating an exemplary embodiment of the image processing unit in an image processing apparatus. When the printing is started by a print instruction from a host computer (not illustrated), a color matching processing unit 131 performs color conversion processing by a color matching table that has been prepared in advance.

More specifically, the color matching processing unit 131 converts red-green-blue (RGB) signals representing colors of the image transmitted from the host computer into device RGB signals (hereafter, referred to as "Dev RGB"), which are matched to a color reproduction region of the image forming apparatus. A color separation processing unit 132 converts the DevRGB signals into cyan-magenta-yellow-black (CMYK) signals, which represent colors of toner color materials used by the image forming apparatus, by a color analysis table that has been prepared in advance.

A density correction processing unit 133 reads a density correction table for correcting the gradation/density characteristics stored in a random access memory (RAM) 138 according to an instruction of a central processing unit (CPU) 137, and converts the CMYK signals into C'M'Y'K' signals in which the gradation/density characteristics is corrected by the density correction table.

Subsequently, a halftone processing unit 134 performs half tone processing to convert the C'M'Y'K' signals into C"M"Y"K" signals. A pulse width modulation (PWM) processing unit 135 converts the C"M"Y"K" signals using a pulse width modulation (PWM) table into exposure times Tc, Tm, Ty, and Tk of scanning units (24C, 24M, 24Y, and 24K in FIG. 1) respectively, which correspond to the C"M"Y"K" signals, as described below.

[Density Sensor Configuration Diagram]

Figure 3:
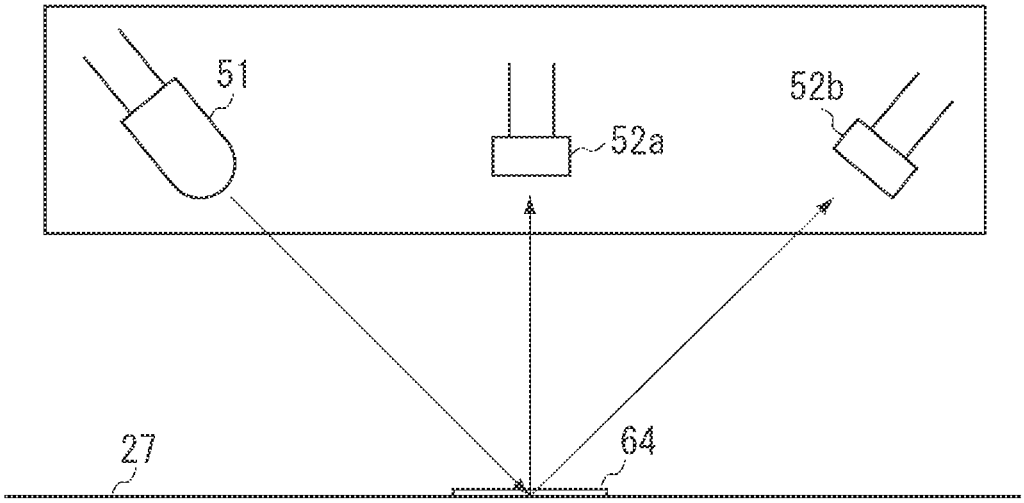
FIG. 3 illustrates an exemplary embodiment of an optical characteristics detection unit.

FIG. 3 illustrates an exemplary embodiment of the density sensor 41 that performs an optical characteristics detection. The density sensor 41 includes a holder (not illustrated) storing an infrared ray emitting element 51, such as a light emitting diode (LED), light-sensitive elements 52*a* and 52*b*, such as a photo diode and correlated double sampling (CDS) circuit, and an integrated circuit (IC) (not illustrated) that processes data of the received light.

A light-sensitive element 52*a* detects diffused reflected light, and a light-sensitive element 52*b* detects diffused reflected light and reflected light from a toner patch. Detection results of the diffused reflected light of the light-sensitive element 52*a* is eliminated from detection results of the light-sensitive element 52*b* to acquire strength of the reflected light. The strength of the reflected light is used to evaluate the density. Basically, the strength of the reflected light can correspond to the density one to one.

Results of detecting the reflected light or the density based on that detection results are used in following descriptions. Those descriptions can be replaced with each other. Both descriptions represent density information about the density, and thus are not substantially different from each other. Therefore, a reflected light change may be referred to as a density change.

[Description about Density Correction Mode]

(i) Density Correction Mode When Normal Operation is Performed

When the image forming apparatus of the present exemplary embodiment has performed the predetermined number of printings, the image forming apparatus starts the density correction mode. A trigger for starting the density correction mode is not limited to the number of printings, but may be, for example, the number of rotations of the photosensitive drum or the number of printing dots, as long as a parameter enabling prediction of an occurrence of the density change is used. Alternatively, the trigger may be information about a change of environment such as temperature and/or moisture by a predetermined value or more from when the correction mode was performed previous time. In following descriptions, processing of a specified color will be described. However, processing of a flowchart described below is performed independently on respective CMYK colors.

Figure 4:
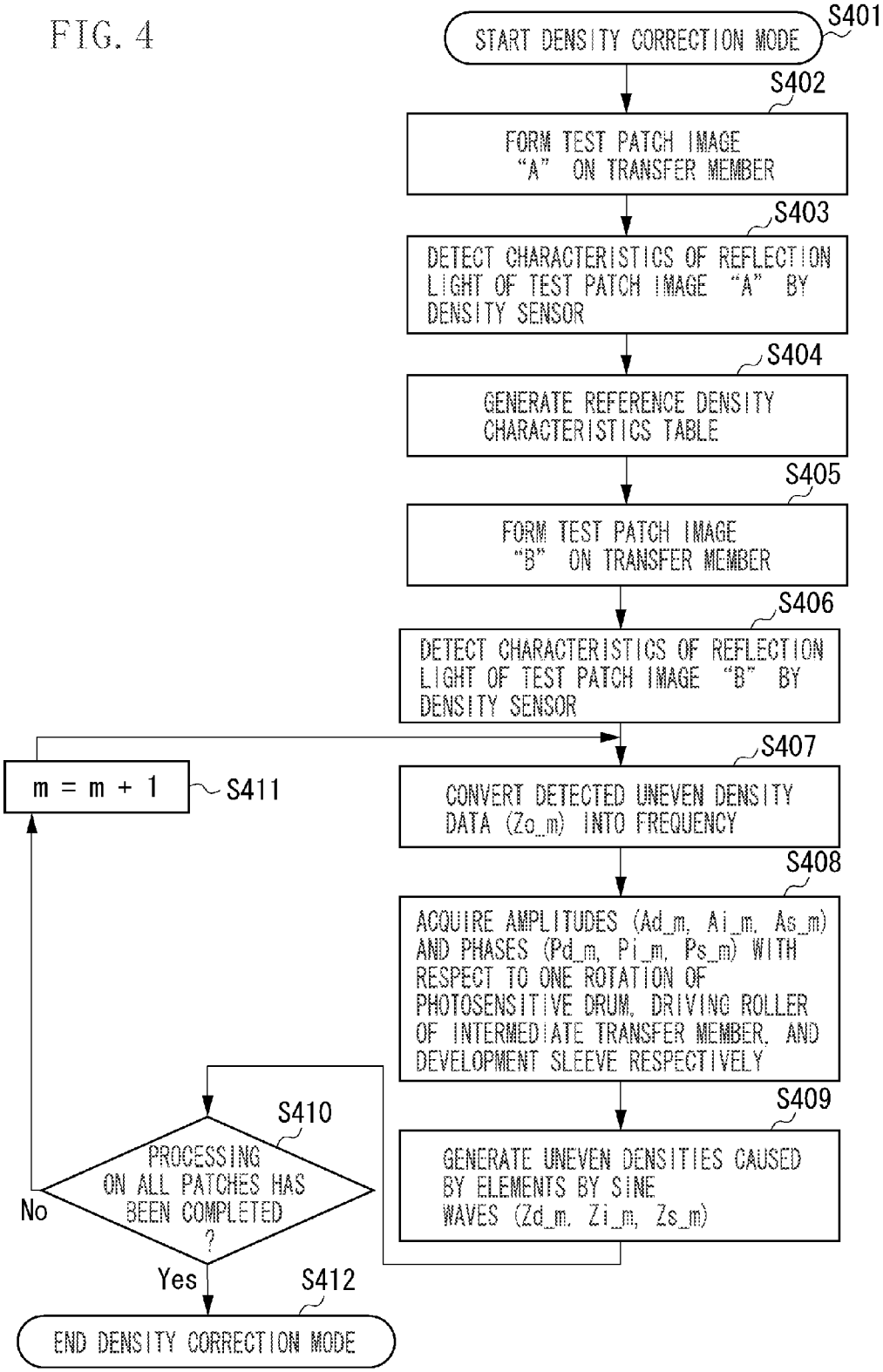
FIG. 4 is a flowchart illustrating an exemplary embodiment of an uneven density detection processing.

FIG. 4 is a flowchart illustrating an exemplary embodiment of uneven density detection processing. In step S401, the density correction mode is started. In step S402, according to the instruction of the CPU 137, a test patch image generation unit 136 generates a test patch image "A" and forms the test patch image "A" on the intermediate transfer member 27 through the density correction processing unit 133, the halftone processing unit 134, and the PWM processing unit 135.

The CPU 137 performs various types of controls to form the test patch image "A". In practice, respective related parts illustrated in FIG. 1 form the toner image on the intermediate transfer member 27. Other patches described below are similarly formed, and forming the patch refers to the formation of the toner image as described above.

Figure 5:
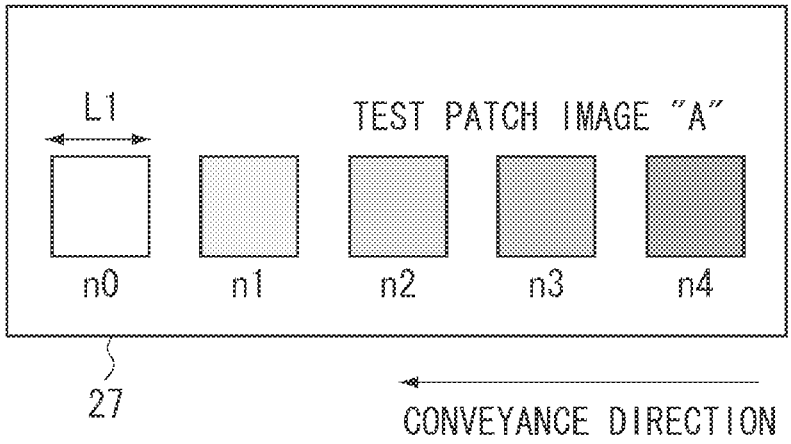
FIG. 5 illustrates an example of a test patch image.

FIG. 5 illustrates the test patch image "A" formed on the intermediate transfer member 27. Each patch constituting the test patch image "A" corresponds to the gradation values n0, n1, n2, n3 and n4. When the test patch image "A" is output, a so-called through table of input=output is used as the density correction table of the density correction processing unit 133.

In step S403, the density sensor 41 detects characteristics of reflected light from the test patch image "A" formed on the intermediate transfer member 27 as the density information. At this point, the density sensor 41 detects the reflected light while each patch is moving a length L1 or more beneath the density sensor 41 in the conveyance direction. The CPU 137 calculates the density of each patch from an average value of strength signals, which are acquired by eliminating strength of the detected diffused reflected light from strength of the detected reflected light. Calculated densities for n0, n1, n2, n3, and n4 are defined as Y0, Y1, Y2, Y3, and Y4 respectively.

Figure 6:
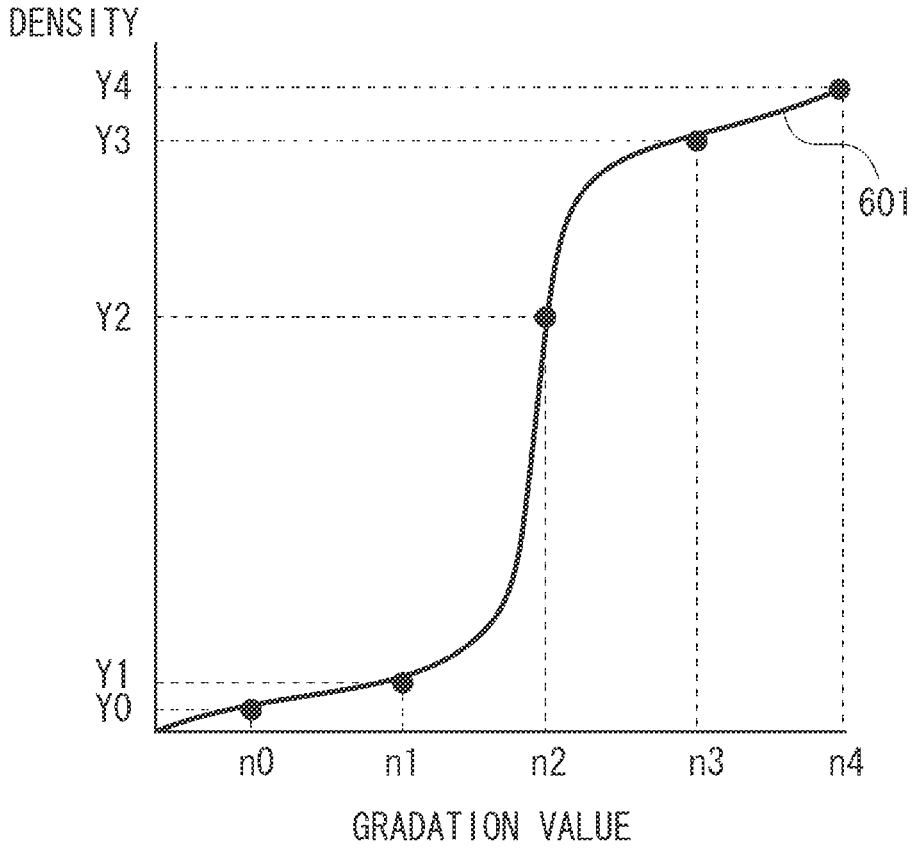
FIG. 6 illustrates an example of gradation values/density characteristics.

In step S404, based on the calculated densities, a density characteristics table for all gradations is generated by an interpolation calculation. FIG. 6 illustrates an example of the density characteristics table, and indicates correspondence relationships between the gradations and the detection results (density values) for each patch. Further, FIG. 6 can be also referred to as reference density characteristics 601, since FIG. 6 illustrates the density characteristics to which no effect of the uneven rotation is added while the image is being formed. The uneven rotation described here refers to periodical rotation speed variation of each rotation member in forming an image illustrated in FIG. 1. Hereinafter, this periodical rotation speed variation of the rotation member is referred to as uneven rotation.

(ii) Density Correction Mode When Printing is Performed Calculate Uneven Density by Detecting Patch In step S405, according to the instruction of the CPU 137, the test patch image generation unit 136 generates a test patch image "B" and forms a plurality of patches on the intermediate transfer member 27 in the conveyance direction through the density correction processing unit 133, the halftone processing unit 134 and the PWM processing unit 135. Although the flowchart in FIG. 4 shows that the processing is continuously performed from step S404 to step S405, the processing performed in steps S402, S403, and S404 may be separately performed in terms of timing.

Figure 7:
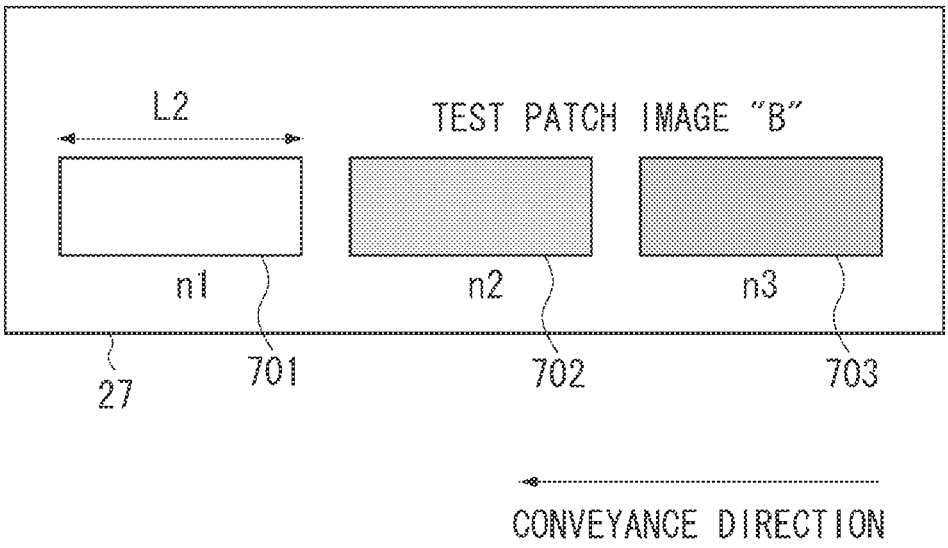
FIG. 7 illustrates an example of a test patch image.

FIG. 7 illustrates the test patch images "B" including patches that has a plurality of gradation values and is formed on the intermediate transfer member 27. The test patch image "B" illustrated in FIG. 7 includes a patch 701 having a gradation n1, a patch 702 having a gradation "n2", and a patch 703 having a gradation n3. For example, a highlight density is assigned to the gradation n1, a middle density is assigned to the gradation "n2", and a high density is assigned to the gradation n3. Respective patches are referred to as patch 1, patch 2 and patch 3. A length "L2" of the test patch images 701, 702, and 703 in the conveyance direction is longer than any revolutions of the photosensitive drum, the driving roller of the intermediate transfer material, and the development sleeve described below.

In step S406, the density sensor 41 irradiates the test patch image "B" formed on the intermediate transfer member 27 with light, and detects reflected light characteristics as density information. The CPU 137 converts the strength of the detected, reflected light into density values. Results of detecting the densities of patches 1, 2, and 3 are defined as Z_1, Z_2, and Z_3 respectively.

Figure 8:
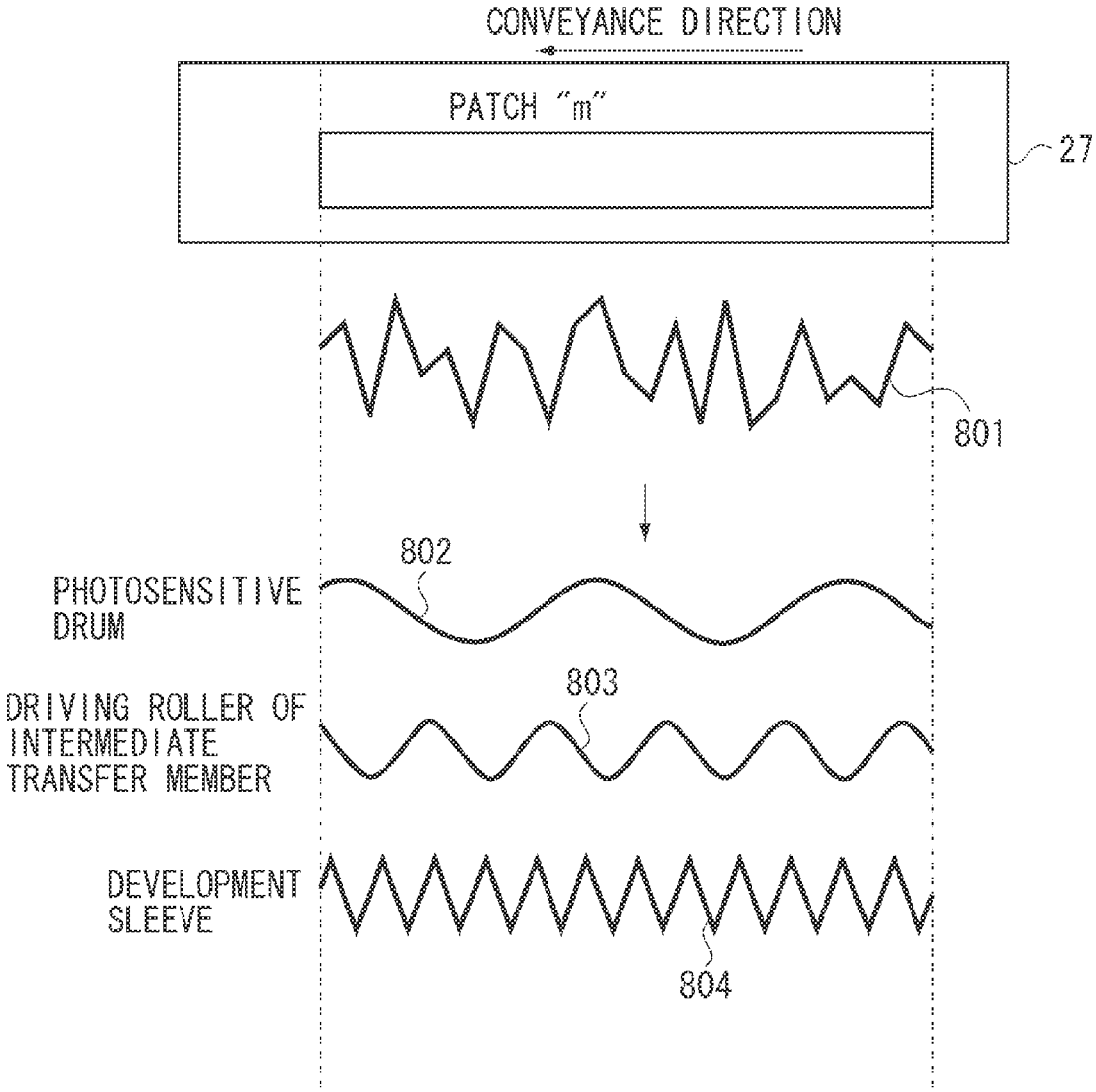
FIG. 8 illustrates an example of results of detecting density changes.

FIG. 8 illustrates an example of detection results (after being converted into the densities) of the density changes (which correspond to a reflected light change) by the density sensor 41 in the conveyance direction (sub-scanning direction). A waveform 801 illustrated in FIG. 8 indicates the density detection result Z_m of a patch "m". Further, as illustrated in FIG. 8, several types of uneven rotations of the rotation member are generated while the image is being formed, and thus the uneven density is generated in the conveyance direction due to the uneven rotation. Types of revolutions of the uneven rotations can include one rotation frequency Td of the photosensitive drums 22Y, 22M, 22C, and 22K and one rotation frequency Ti of the driving roller of the intermediate transfer member 42.

Further, the types of revolutions can include one rotation frequency Ts of the development sleeves (development rollers) 26YS, 26MS, 26CS and 26KS of FIG. 1. A unit of the frequency "T" of the uneven rotation is defined as "mm". And in FIG. 8, the uneven density for each element described above can be extracted or acquired. The waveforms 802, 803, and 804 in FIG. 8 are schematically illustrated, and can be approximated to a sign wave as described below. Therefore, in effect, the waveform 801 can be slightly changed. Further, an original image of the patch "m" shows uniform density. If the uneven rotation for forming an image is zero, an alternating current (AC) component of the detection result Z m of the density is zero. In addition, the density of the patch "m" may be 100% or 80% as long as the density detection result Z m can be detected.

More specifically, in step S407, the CPU 137 converts the result Z_m into a frequency space by, for example, fast Fourier transformation (FFT). In step S408, the CPU 137 acquires amplitudes Ad_m, Ai_m, and As_m, and phases Pd_m, Pi_m, and Ps_m relative to frequencies (1/Td), (1/Ti), and (1/Ts) respectively. Particularly, the phases are determined based on a state of the density change at reference timing when exposure of a leading end of the patch "m" is started.

FIG. 9 illustrates a list of parameters calculated by the FFT described above. In step S409, the CPU 137 acquires the information about the uneven density caused by each element from information about the amplitude and the phase of each element acquired by, for example, the FFT as described above using following sine wave equations. As described above, the information about the uneven density can be also referred to as the information about the reflected light change in the sub-scanning direction (conveyance direction).

$$Zd_m(D_m)=Ad_m\times\mathrm{Sin}((D_m)/Td*2*n+Pd_m) \quad \text{(Equation 1)}$$

$$Zi_m(D_m)=Ai_m\times\mathrm{Sin}((D_m)/Ti*2*n+Pi_m) \quad \text{(Equation 2)}$$

$$Zs_m(D_m)=As_m\times\mathrm{Sin}((D_m)/Ts*2*n+Ps_m) \quad \text{(Equation 3)}$$

Parameters included in above-described equations are defined as follows.

D_m is a distance (rotation amount) that an intermediate transfer material moves since exposure of a leading end of a patch "m" has been started. Zd_m is an uneven density caused by a photosensitive drum when an intermediate transfer member 27 moves the distance D_m since the exposure of the leading end of the patch "m" has been started. Zi_m is an uneven density caused by a driving roller of an intermediate transfer belt when an intermediate transfer member 27 moves the distance D_m since the exposure of the leading end of the patch "m" has been started.

Zs_m is an uneven density caused by a development sleeve when an intermediate transfer member 27 moves the distance D_m since the exposure of the leading end of the patch "m" has been started. In FIG. 8, the waveform 802 indicates the uneven density Zd_m caused by the photosensitive drum, the waveform 803 indicates the uneven density Zi_m caused by the driving roller of the intermediate transfer belt, and the waveform 804 indicates the uneven density Zs_m caused by the development sleeve.

For example, when the intermediate transfer material moves at a predetermined speed "V" [mm/sec], the distance D_m that the intermediate transfer material moves since the exposure of the leading end of the patch "m" has been started can be calculated from a time (Te_m×V) since the exposure of the leading end of the patch "m" has been started. In other words, the distance can be expressed by the time. Further, an amount of movement of each rotation member such as the intermediate transfer member 27 corresponds to an amount of driving of each driving source (motor) that drives each rotation member. Thus, speed information (function generator (FG) pulse) output from the motor can be counted as distance information, and a rotation movement distance (rotation amount) that each rotation member is driven can be measured from the number of counts.

The parameter D_m will be described as the distance that the intermediate transfer material moves, however, the parameter D_m can be represented by other words. The distance that the intermediate transfer material moves can be also referred to as a distance that a surface of the rotation member moves such as the photosensitive drum and the driving belt of the intermediate transfer belt, and the development sleeve that are driven together with the intermediate transfer material. This distance will be hereafter referred to as the rotation movement distance. As described above, the distance described in the present exemplary embodiment can be converted into the time, and thus the distance can be referred to as the time.

Returning to FIG. 4, when the processing is completed on the patch, in step S410, the CPU 137 determines whether the processing is completed on all patches. When the processing is not completed on all patches (NO in step S410), in step S411, the patch "m" is advanced by "1". The processing in steps S407, S408, and S409 is performed on a next patch. On the other hand, when the processing is completed on all patches (YES in step S410), in step S412, the density correction mode is ended. By the processing described above, Zd_m (D_m), Zi_m (D_m), and Zs_m (D_m), (m=1, 2, 3) are calculated. With this calculation, various types of uneven densities generated by a printer in operation can be acquired at arbitrary timings.

Calculate Uneven Density of Print Image at Arbitrary Position

With reference to the flowchart illustrated in FIG. 10, processing for correcting the density when the printing is started will be described. This processing is performed corresponding to each page and independently from another processing before exposure processing is performed on, at least, a focused page. Further, this processing is performed continuously from the processing illustrated in FIG. 4. More specifically, the CPU 137 continues the processing following FIG. 4 and continuously monitors the distance that the rotation member moves since the exposure of the leading end of the patch "m" has been started.

Figure 10:
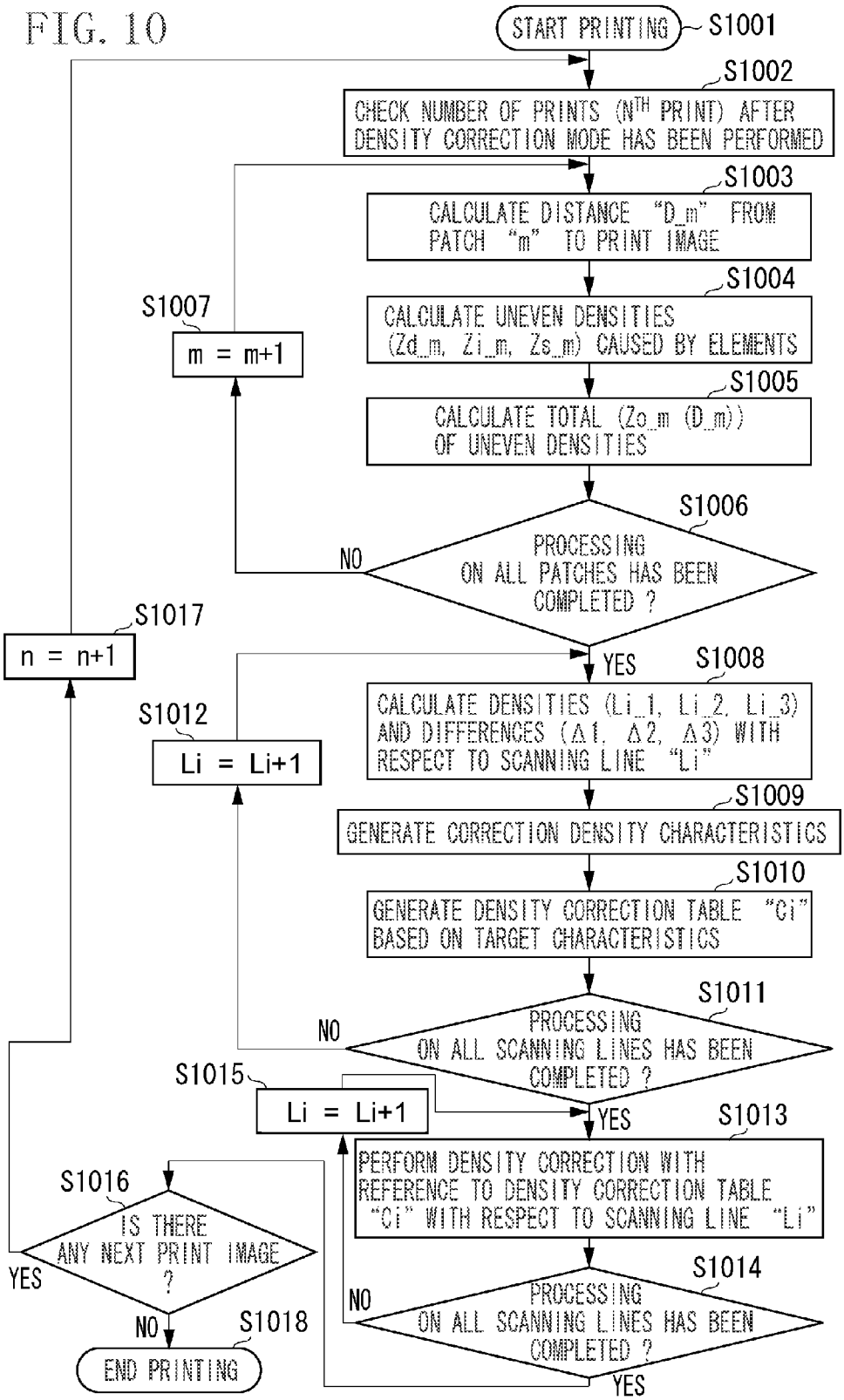
FIG. 10 is a flowchart illustrating an exemplary embodiment of density correction processing when printing is performed.

FIG. 10 is a flowchart illustrating an exemplary embodiment of the density correction processing when the printing is performed. In step S1001, the printing is started, and then in step S1002, the CPU 137 checks the number of prints that have been printed since the density correction mode has been ended. The CPU 137, then, checks what page is the focused page to be printed.

Processing of the patch "m" (m=1, 2, 3) will be described. In step S1003, the CPU 137 acquires the distance D_m that the intermediate transfer material moves since the reference timing when the exposure of the leading end of the patch "m" has been started. As described above, the CPU 137 monitors the movement distance D_m continuously following the processing illustrated in FIG. 4. When the printing is performed, timing when the photosensitive drum is exposed with the leading end of the patch "m" is defined as Te0 and timing when an arbitrary position of the print image is exposed is defined as Te1. Then, the following equations can be satisfied.

Figure 11:
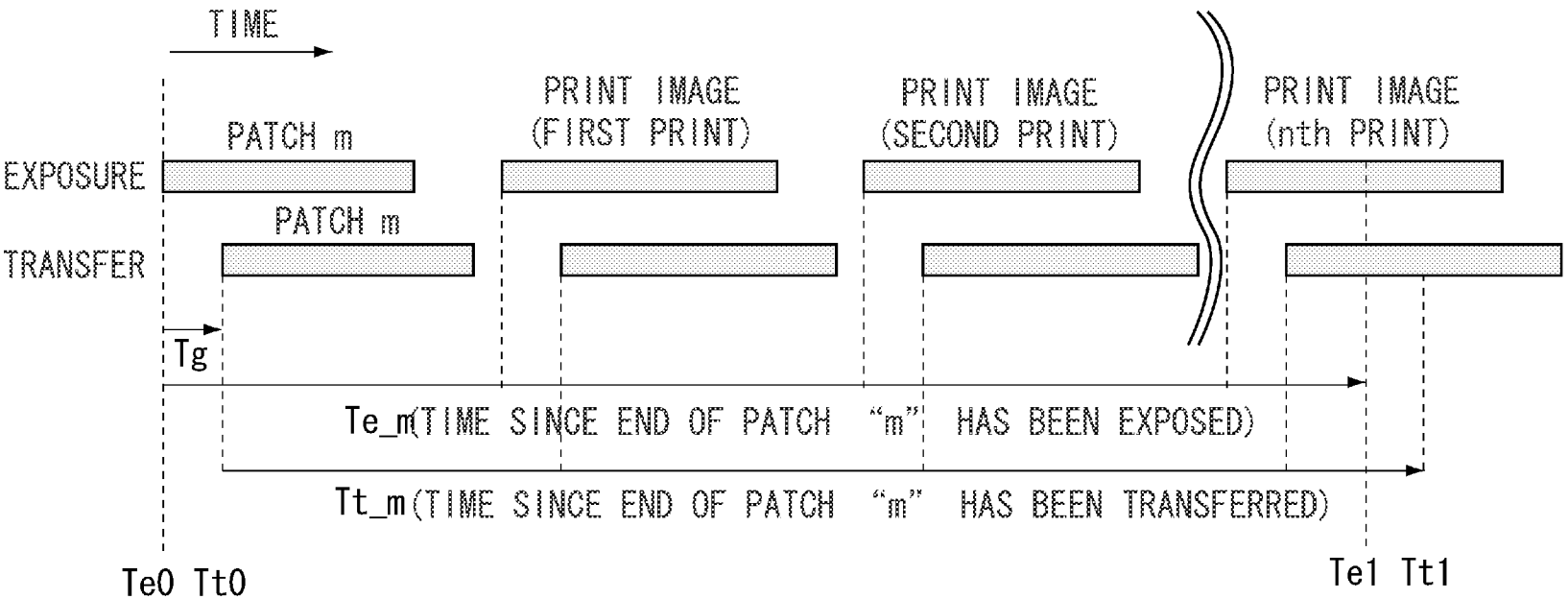
FIG. 11 illustrates an example of relationships between exposure timings and transfer timings.

More specifically, a time Te_m (corresponding to D_m) from when exposure of the leading end of the patch "m" has been started to when exposure of the arbitrary position of the print image has been started can be expressed as Te_m=Te1−Te0 as illustrated in FIG. 11. Further, when the printing is performed, timing when the leading end of the patch "m" is transferred onto the intermediate transfer material is defined as Tt0, and timing when the arbitrary position of the print image is transferred is defined as Tt1. Then, the following expressions can be satisfied.

In other words, a time Tt_m from when the leading edge of the patch "m" is transferred to when the arbitrary position of the print image is transferred can be expressed as Equation (1).

$$Tt_m=Tt1-Tt0 \quad (1)$$

If a time since when the exposure of the arbitrary position of the print image is started until when the transfer thereof is started is defined as Tg, Equations (2) and (3) can be satisfied.

$$Tt0-Te0=Tg \quad (2)$$

$$Tt1-Te1=Tg \quad (3)$$

Accordingly, Tt_m=Te_m can be satisfied. In other words, an exposure interval is equal to a transfer interval.

In step S1004, the CPU 137 calculates each density change caused by the uneven rotation of each rotation member at a position after advancing an arbitrary distance D_m from where the photosensitive drum is exposed with the leading edge of the patch "m" (reference timing). The CPU 137 calculates the density changes caused by uneven rotation of each rotation member regarding all D_m within the focused, current page.

Since a reference state (phase) at a reference position (reference timing) in equations 1, 2, and 3 can be specified, the state (phase) of the uneven density at the arbitrary position (arbitrary timing) including the reference position (reference timing) can be specified. By specifying the state, the density change at the position (timing) advancing the arbitrary distance D_m from the reference timing can be calculated.

Figure 12:
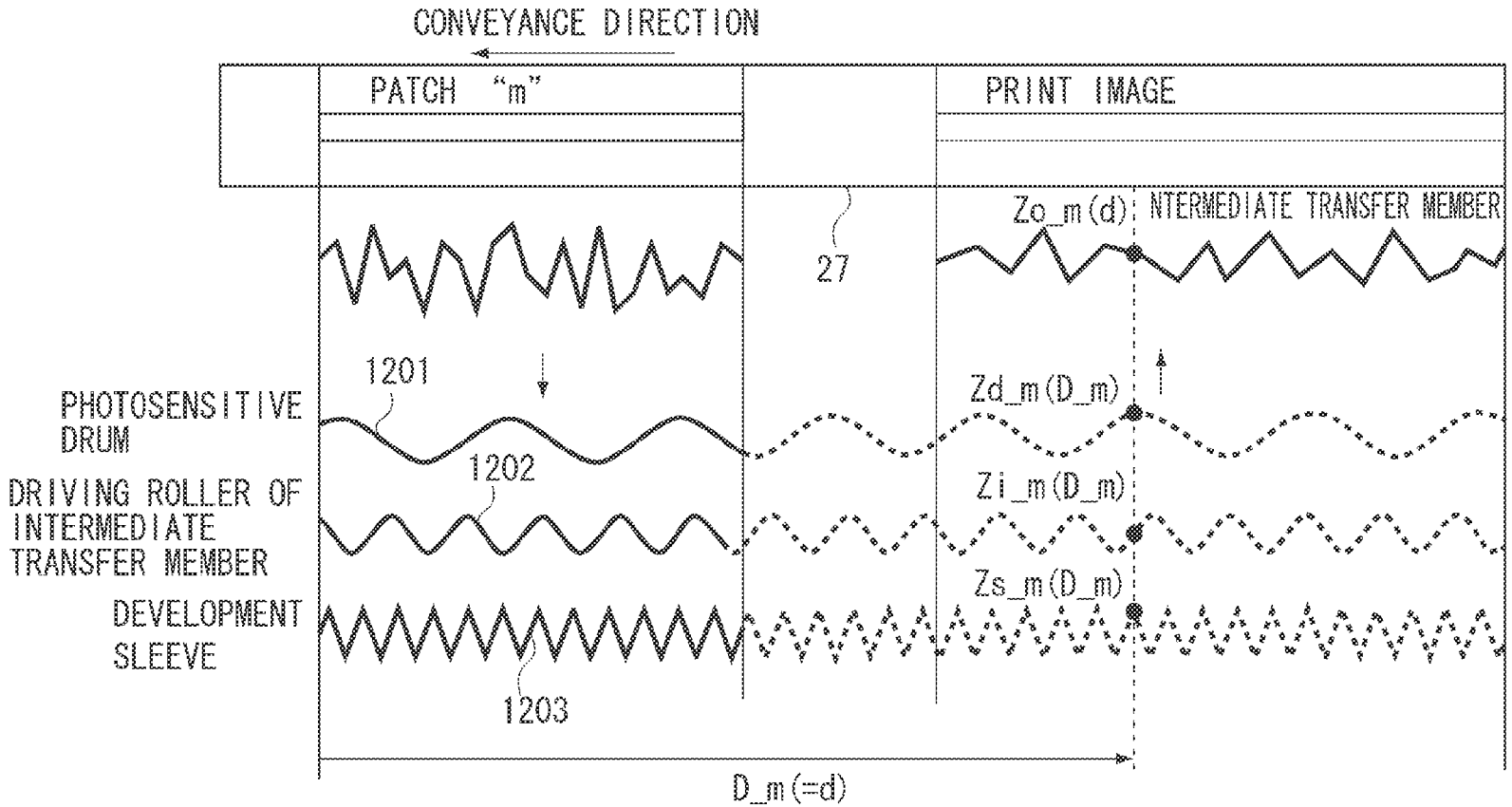
FIG. 12 illustrates an example of correspondence relationships between density changes caused by uneven rotations of rotation members on a patch "m" and those on a print image.

FIG. 12 illustrates an example of correspondence relationships between the distance that the intermediate transfer member 27 moves from a position of the leading end of the patch "m", and the density changes caused by the uneven rotations of the rotation members. When the uneven density correction is performed, the distance D_m (=d) illustrated in FIG. 12 corresponds to information of the movement distance assumed by the CPU 137. Further, when the exposure is performed, the distance D_m (=d) represents the information about the substantially measured (monitored) distance that the rotation member moves.

As illustrated in FIG. 12, the CPU 137 calculates the density of each cause of unevenness at the position D_m when the image is printed, from the uneven density 1201 caused by the photosensitive drum, the uneven density 1202 caused by the driving roller of the intermediate transfer belt, and the uneven density 1203 caused by the development sleeve that are generated in the density correction mode. The densities of the respective causes are defined as Zd_m (D_m), Zi_m (D_m), and Zs_m (D_m).

In step S1005, the CPU 137 calculates a total density Zo_m (D_m) of a current, focused patch "m" using Equation (4).

$$Zo_m(D_m)=Zd_m(D_m)+Zi_m(D_m)+Zs_m(D_m) \quad (4)$$

Since, the reference state (phase) at the reference position (reference timing) in Equations (1), (2), and (3) can be specified, the reference state (phase) at the reference position (reference timing) can be also specified in Equation (4).

Therefore, by Equation (4), the state (phase) of the uneven density at the arbitrary position (arbitrary timing) including the reference position (reference timing) can be also specified, and thus the density change at the position (timing) advancing the arbitrary distance D_m from the reference timing can be acquired. The phase of the total density Zo_m (D_m) represents information for specifying a position in one revolution. For example, when one revolution is divided into 1,000 points of 0 to 999, the information indicates at what number the current point is among 1,000 points.

In step S1006, the CPU 137 determines whether the processing is completed on all patches. When the processing is not completed on all patches (NO in step S1006), in step S1007, the patch "m" is advanced by "1", and the processing on a next patch returns to step S1003. When the processing is completed on all patches (YES in step S1006), the processing proceeds to step S1008. The processing performed in steps S1002, S1003, S1004, S1005, S1006, and S1007 does not have to be repeatedly performed on a next page after the processing in step S1008 and following steps thereof is performed, but may be performed on all pages at a time.

Figure 13:
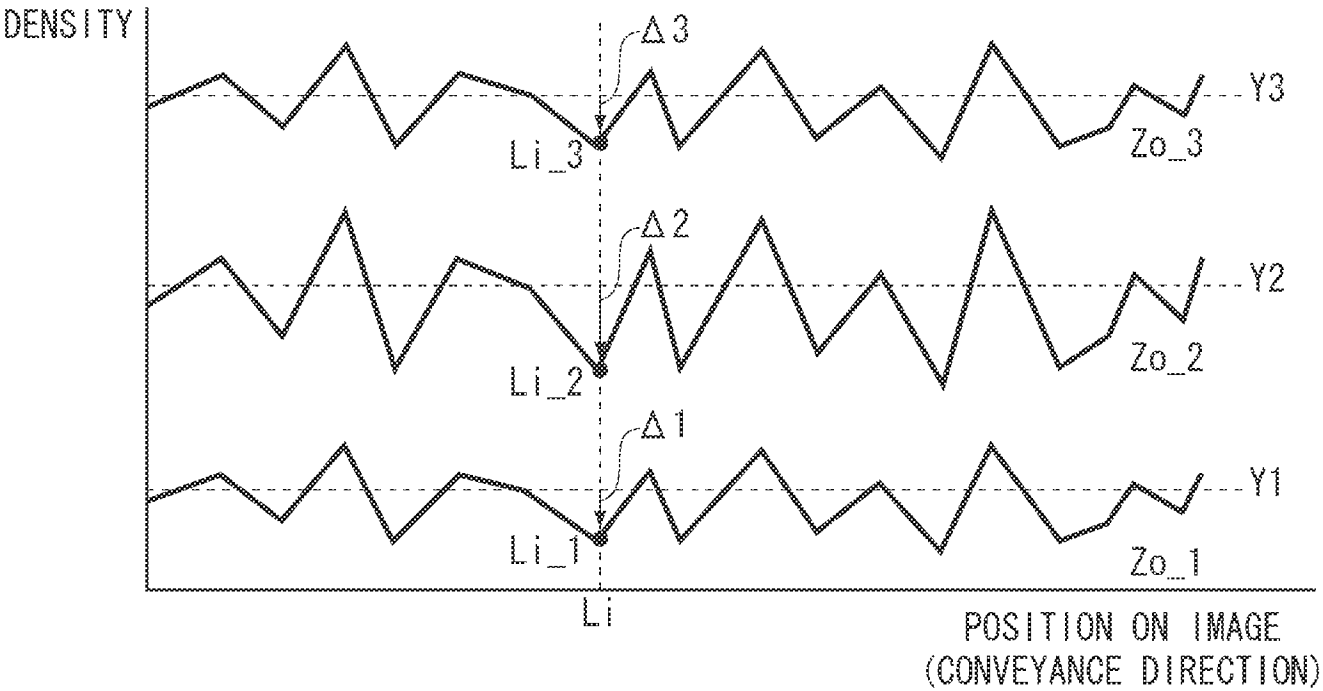
FIG. 13 illustrates a state where densities of images having respective gradations change at sub-scanning positions.

By the processing described above, the results Zo_1 (D_1), Zo_2 (D_2), and Zo_3 (D_3) of the patches 1, 2, and 3 can be calculated respectively. FIG. 13 illustrates a state where densities of the images having respective gradations change at respective sub-scanning positions. FIG. 13 illustrates the results Zo_1 (D_1), Zo_2 (D_2), and Zo_3 (D_3) at the positions in the conveyance direction of the images. As described above, a level of the density correction can be changed according to the gradation values of the image, which is a correction target as well as the movement distance D_m. The present exemplary embodiment can deal with such a state.

Calculate Uneven Density for Each Scanning Line

The processing on each scanning line will be described. An $i^{th}$ scanning line Li will be described as an example. The "scanning line Li" refers to information about the image which forms the scanning line Li. In step S1008, the CPU 137 calculates the changed density of the scanning line Li.

The density of the $i^{th}$ scanning line Li is determined by a distance (D_m) that a position of the scanning line Li is away/separated from the leading end of the patch "m". In the flowchart illustrated in FIG. 10, the distance D_m for the scanning line Li, which has not been exposed yet, is determined in advance to correct the density. Corresponding to the rotation of the rotation member in the movement distance D_m, the scanning unit 24 is controlled to emit the light image of the corresponding, corrected scanning line Li.

The corrected image of the scanning line Li is acquired from Zo_1 (D_1), Zo_2 (D_2), and Zo_3 (D_3). For example, the density of Zo_1 (D_1), Zo_2 (D_2), and Zo_3 (D_3) of the scanning line Li are defined as Li_1, Li_2, and Li_3 respectively. Differences (amount of density changes) of measurement results Y1, Y2, and Y3 of the test patch image "A", which are an average density (averaged uneven density) of the gradations n1, n2, and n3 are calculated as follows and defined as Δ1, Δ2, and Δ3 in Equations (5), (6), and (7).

$$\Delta 1=Li_1-Y1 \quad (5)$$

$$\Delta 2=Li_2-Y2 \quad (6)$$

$$\Delta 3=Li_3-Y3 \quad (7)$$

Figure 14:
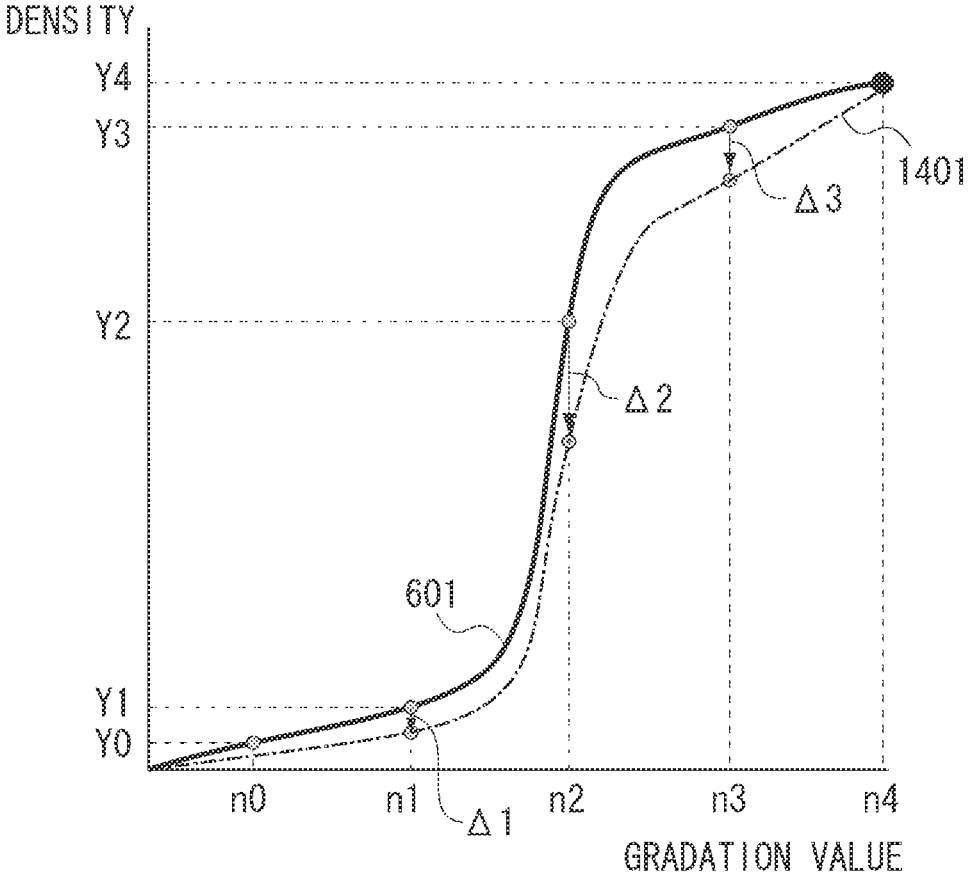
FIG. 14 illustrates an example of the gradation values/density characteristics to which an amount of the density changes caused by the uneven rotation of a motor is added.

In step S1009, as illustrated in FIG. 14, the CPU 137 generates correction density characteristics. The correction density characteristics can be acquired by changing the densities of the reference density characteristics 601 illustrated in FIG. 6, which is acquired by measuring the test patch image "A", for the gradation n1, n2, and n3 by Δ1, Δ2, and Δ3 respectively. FIG. 14 illustrates the corrected density characteristics 1401 relative to the reference density characteristics 601.

Generate Density Correction Table for Each Scanning Line

In step S1010, a correction table generation unit 139 generates a density correction table Ci for setting the density of an input gradation to be density characteristics of a target.

Figure 15:
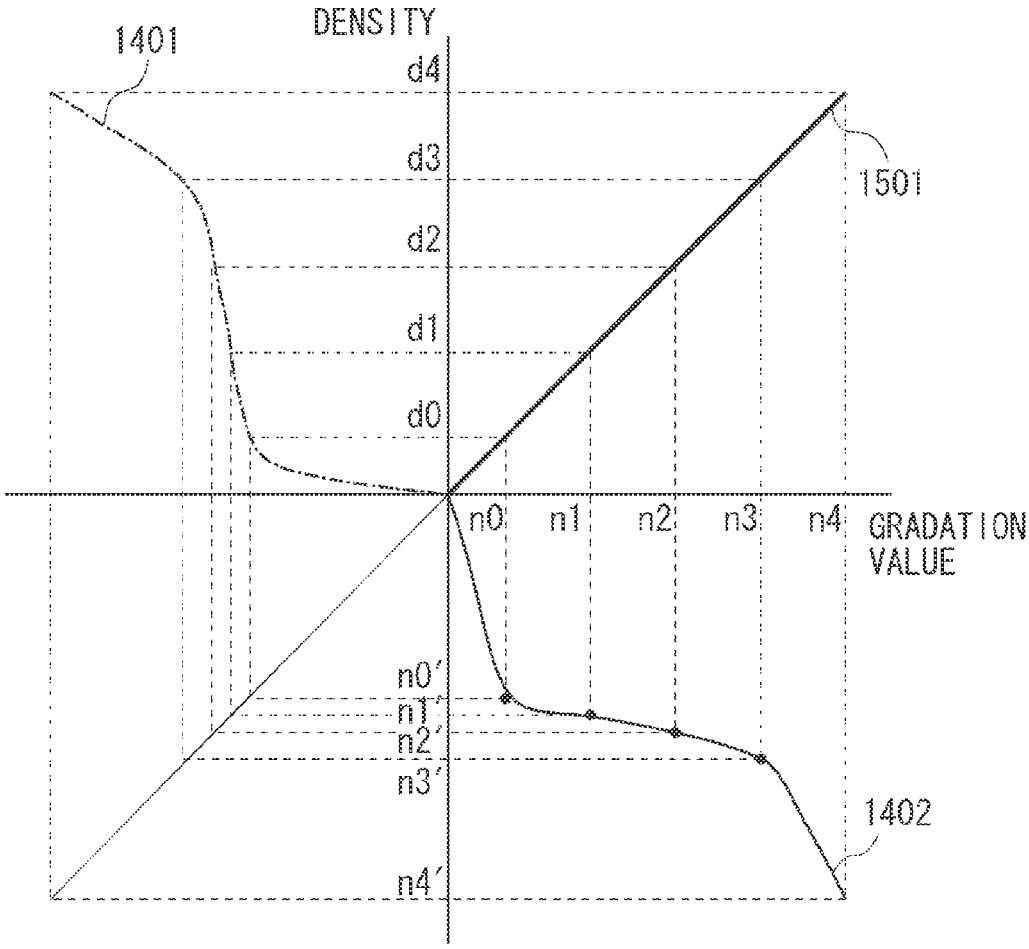
FIG. 15 illustrates an exemplary embodiment of a procedure for generating a correction table.

In FIG. 15, density characteristics 1501 of the target have a straight line shape. FIG. 14 illustrates density characteristics 1401 at certain timings in consideration of an effect of the uneven rotation of the rotation member while the image is being formed. The density correction table Ci (density correction information) illustrated in FIG. 15 incorporates a reversed characteristics table 1402 of the density characteristics 1401. By the incorporated, reversed characteristics table 1402, the input gradation values n0, n1, n2, n3, and n4 are converted into n0', n1', n2', n3', and n4' to realize the density characteristics 1501 of the target.

Thus, the density correction table Ci for the scanning line Li can be generated. In step S1011, the CPU 137 determines whether the processing is completed on all scanning lines. When the processing is not completed on all scanning lines (NO in step S1011), in step S1012, the scanning line Li is advanced by "1", and the processing on a next scanning line is returned to step S1008.

When the processing is completed on all scanning lines (YES in step S1011), the density correction table Ci for each scanning line is generated for all scanning lines. The generated density correction table Ci is stored in a random access memory (RAM) 138 or an electrically erasable programmable read-only memory (EEPROM) (not illustrated). In the above description, the density correction table Ci is generated for all scanning lines Li, however, it is not limited thereto. Considering a memory capacity and image quality, the density correction table Ci can be shared by several scanning lines.

Correct Density of Scanning Line Image Using Density Correction Table for Each Scanning Line Processing will be described for correcting the image density by the density correction table Ci (density correction information) corresponding to each scanning line, so that the density change that occurs according to the movement distance D_m depending on each scanning line can be cancelled.

Figure 16:
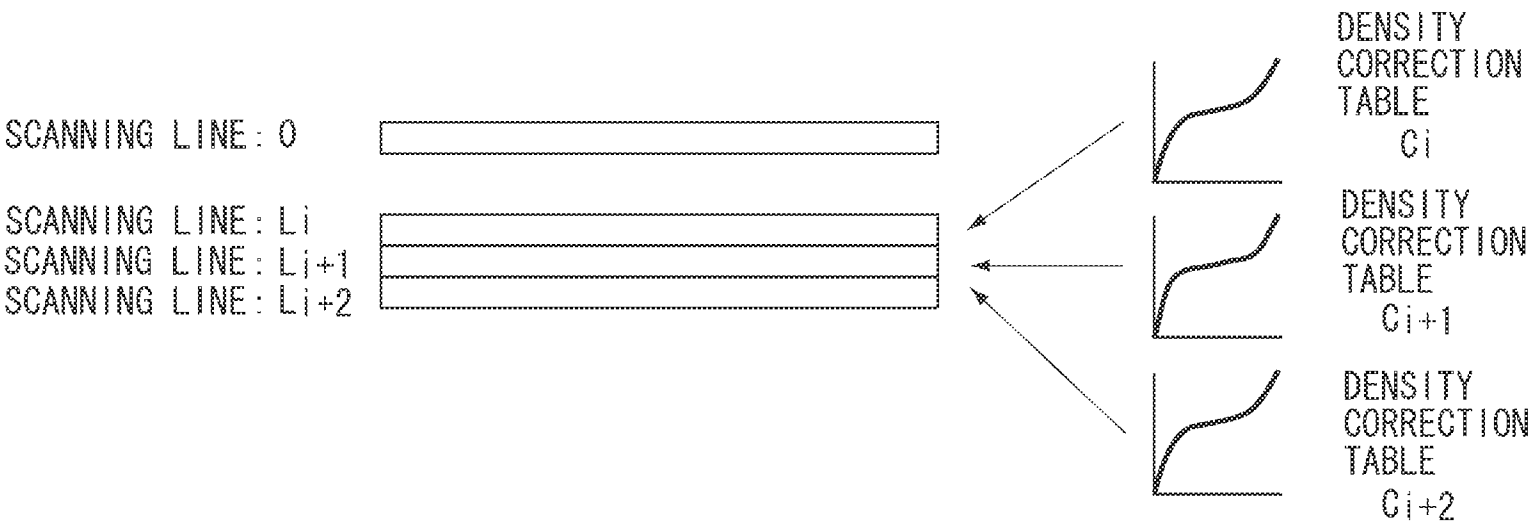
FIG. 16 schematically illustrates a state where density correction tables (density correction information) are switched depending on respective scanning lines.

In step S1013, the density correction processing unit 133 reads the density correction table Ci corresponding to each scanning line Li from the RAM 138 to perform the density correction. FIG. 16 schematically illustrates a state where density correction tables Ci (density correction information) are switched depending on respective scanning lines. As described above, when the density correction table Ci is shared by several scanning lines, the density correction table Ci read from the RAM 138 is common among the several lines.

After the density correction is performed, in step S1014, the CPU 137 determines whether the processing for correcting the density is completed on all scanning lines. When the processing is not completed on all scanning lines (NO in step S1014), in step S1015, the scanning line Li is advanced by "1", and the processing on a next scanning line is returned to step S1013.

On the other hand, when the processing for correcting the density is completed on all scanning lines (YES in step S1014), in step S1016, the CPU 137 determines whether there is any next print image. When there is a next print image (YES in step S1016), in step S1017, "n" is advanced by "1", and the processing on the next print image is returned to step S1002 again. When there is no next print image (NO in step S1016), in step S1018, the processing of the flowchart illustrated in FIG. 10 is ended.

Processing for Exposing with Print Image

As described above, the distance D_m is previously assigned to each scanning line Li, and the density correction is performed on each scanning line Li according to the assigned distance D_m. The CPU 137 measures the distance (information about movement distance) that the rotation member actually moves. Further, the CPU 137 allows the scanning unit 24 to perform the exposure at timing when the rotation member has moved the distance D_m, based on the scanning line Li (image) to which the movement distance D_m is assigned. FIG. 12 illustrates relationship between the movement distance D_m to be measured and the reference timing (e.g., timing when the exposure of the leading end of the patch is started) described above.

If the CPU 137 monitors the movement distance D_M corresponding to a first scanning line L1 and allows the scanning unit 24 to perform the exposure at timing when the rotation member has moved the distance D_m, subsequent banding corrections are automatically performed. More specifically, within the page, when the scanning is performed, the distance D_m that the rotation member moves is previously assigned to each scanning line (image) to be scanned after the scanning line L1 is scanned, and the density correction is performed according to the movement distance D_m as described above. Thus, the banding can be decreased.

As described above, according to the present exemplary embodiment, even if similar banding does not always occur at a same position of a recording medium, the appropriate banding correction can be performed in the printing.

According to the present exemplary embodiment, the uneven rotations of the photosensitive drum, the driving roller of the intermediate transfer belt, and the development sleeve are considered as the major causes of the uneven density, and the processing is performed to correct the uneven rotations. However, causes of the periodically-uneven density is not limited to the causes described above. Further, visual characteristics of humans may be also considered and the correction may be performed focusing on a visually sensitive frequency, or an element having a predetermined level of amplitude or more can be taken as the correction target.

Furthermore, according to the present exemplary embodiment, the number of patches of the test image "A" is set to be five, and the number of patches of the test image "B" is set to be three. However the numbers of the patches are not limited to the above numbers. The number of patches may be set according to a constitution of the adopted image forming apparatus or a required correction accuracy. Moreover, as described above, the density correction table is generated after the printing has been started. However, if the movement distance D_m can be measured from the reference timing, the density correction table may be generated before the printing is started (before a printing order is input from outside).

In the above description, as illustrated in FIG. 7, regarding the test patch image "B", three patches having the respective gradations n1, n2, and n3 are formed. However, gradations are not limited to the ones described above. For example, even if only one gradation represents the gradations of the test patch image "B" to be formed, a good banding correction can be realized. By adopting one gradation, an amount of toner to be used for the patches can be saved. The present exemplary embodiment basically refers to FIGS. 1 through 12. Details focusing on differences between the first exemplary embodiment and the second exemplary embodiment will be described.

In the flowchart illustrated in FIG. 4, m=1 is assumed. The processing in Steps 401, 402, 403, 404, 405, 406, 407, 408, and 409 is performed on a test patch image "B" having one representative gradation, and "YES" is determined in step S410. As the representative gradation, for example, a gradation "n2" used in the first exemplary embodiment can be adopted. Therefore, in this case, the test patch image "B" has only one gradation "n2".

FIGS. 8 through 12 may also adopt m=1 (test patch image "B" of representative gradation). Therefore, in step S1006 in the flowchart illustrated in FIG. 10, when the processing is completed on one patch, "YES" is determined.

Figure 17:
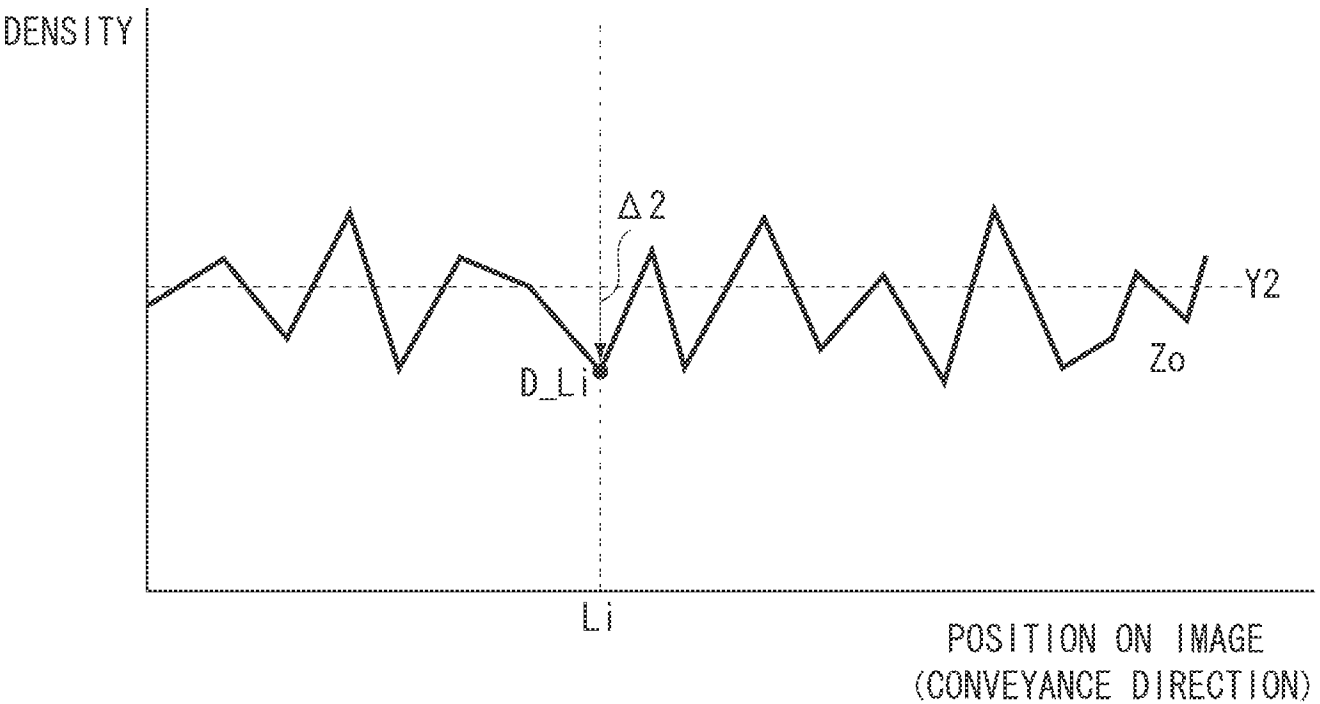
FIG. 17 illustrates a state where the density changes at respective sub-scanning positions.

Details about the density correction processing for each main-scanning line in the second exemplary embodiment will be described below. When the printing is performed, a distance on the intermediate transfer material from the leading end of the patch to the above-described position of the print image is defined as "D". As with the first exemplary embodiment, the total uneven density calculated from the uneven densities generated by the density correction mode is defined as Zo (D) as illustrated in FIG. 17.

For example, the density of Zo (D) of the scanning line Li becomes D_Li. A difference between D_Li and the measuring result Y2 of the test patch image "A", which is the average density (averaged uneven density) of the gradation "n2", is calculated and defined as Δ2. The difference Δ2 can be expressed as Δ2=D_Li−Y2 as described above in Equation 6.

Figure 18:
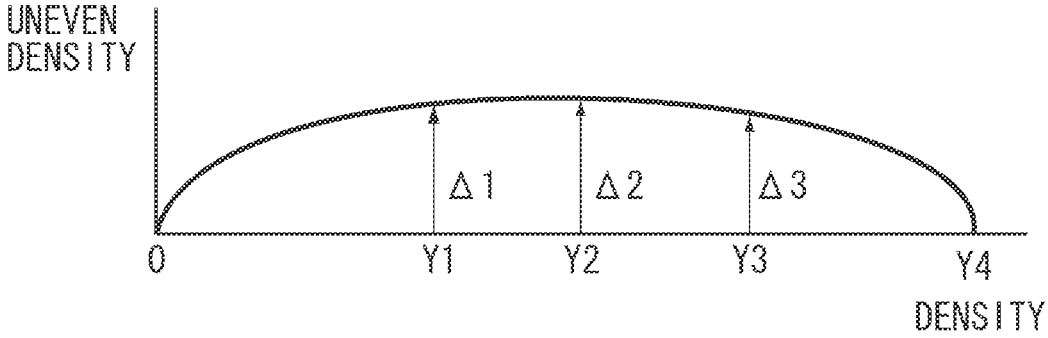
FIG. 18 illustrates an example of relationship between densities (gradation values) and uneven densities.

In the image forming apparatus of the present exemplary embodiment, relationship between the image density and the uneven density caused by the same uneven rotation has the characteristics as illustrated in FIG. 18. When the image density is defined as "Y" and the uneven density is defined as Δd, the characteristics of FIG. 18 can be expressed as Equation (8).

$$\Delta d=-a\times k^2+a\times(Y-k)_2=a\times(Y^2-2\times Y\times k) \quad (8)$$

$$(k=Y4/2)$$

Since Equation (9) is satisfied, Equation (10) can also be satisfied.

$$\Delta 2=a\times(Y2^2-2\times Y2\times k) \quad (9)$$

$$a=\Delta 2/(Y2^2-2\times Y2\times k) \quad (10)$$

Thus, the uneven densities Δ1 and Δ3 in the gradations n1 and n3 corresponding to the average densities Y1 and Y3 respectively can be acquired by Equations (11) and (12).

$$\Delta=\Delta 2/(Y2^2-2\times Y2\times k)\times(Y1^2-2\times Y1\times k) \quad (11)$$

$$\Delta 3=\Delta 2/(Y2^2-2\times Y2\times k)\times(Y3^2-2\times Y3\times k) \quad (12)$$

Hereafter, the similar processing to that in steps S1009, S1010, S1011, S1012, S1013, S1014, S1015, S1016, S1017, and S1018 illustrated in FIG. 10 will be performed. In the present exemplary embodiment, the relationship between the image density and the uneven density is defined by quadratic functions. However, other types of functions or tables maybe used.

In the above descriptions, Ad_m, Ai_m, and As_m are determined based on the detection results by the density sensor 41 for detecting optical characteristics. However, Ad_m, Ai_m, and As m may not be limited to those determinations, but respective representative values of Ad_m, Ai_m, and As_m may be predetermined and used. Alternatively, the values of Ad_m, Ai_m, and As_m may be estimated by calculations depending on each circumstance of the image formation. The applicant confirmed that a certain effect of inhibiting the banding could be obtained also by using this method.

According to the first and second exemplary embodiments, the density correction table Ci illustrated in FIG. 15 is dynamically generated for each scanning line (sequentially) by adding the sequential density changes Zo. The density correction table Ci is used to perform the density correction on the image information. However, a method for correcting the density is not limited to the methods described above. According to the present exemplary embodiment, without changing the density correction table, the present invention can be implemented with fewer loads.

According to a third exemplary embodiment, neither the reference density characteristics 601 nor the density correction table Ci illustrated in FIG. 15 are not corrected corresponding to each laser beam scanning. Instead, the density correction is performed using the density correction table Ci illustrated in FIG. 15, which is not corrected if the dynamic density change Zo does not occur. In this case, the gradation of the image information is corrected so that an amount of the density changes when the density changes Zo (Δ1, Δ2, and Δ3) occur on the density can be cancelled as to the corrected density. With this arrangement, when the corrected image information is corrected using the reference density characteristics 601, the image having the appropriate gradation value can be output.

According to the present exemplary embodiment, after the density correction mode is performed in steps S401, S402, S403, S404, S405, S406, S407, S408, S409, and S410, the similar correction table to that in FIG. 15 is generated using the reference density characteristics 601 acquired in step S404. More specifically, the density characteristics 1401 illustrated in FIG. 15 is the reference density characteristics 601, and the reversed characteristics table 1402 is a reversed characteristics table 602 of the reference density characteristics 601. If the density characteristics 1501 of the target have the straight line shape, as a correction result of the density by the reversed characteristics table 602, the relationship between the gradation "np" and the density "Yp" can be expressed as Yp=f×np ("f" is a constant number).

Subsequently, the image density correction is performed using the generated correction table when the printing is performed. Operations started in step S1001, and performed in steps S1002, S1003, S1004, S1005, and S1006 are similar to those in the second exemplary embodiment. The density correction processing for each main-scanning line of the present exemplary embodiment will be described in detail.

Figure 19:
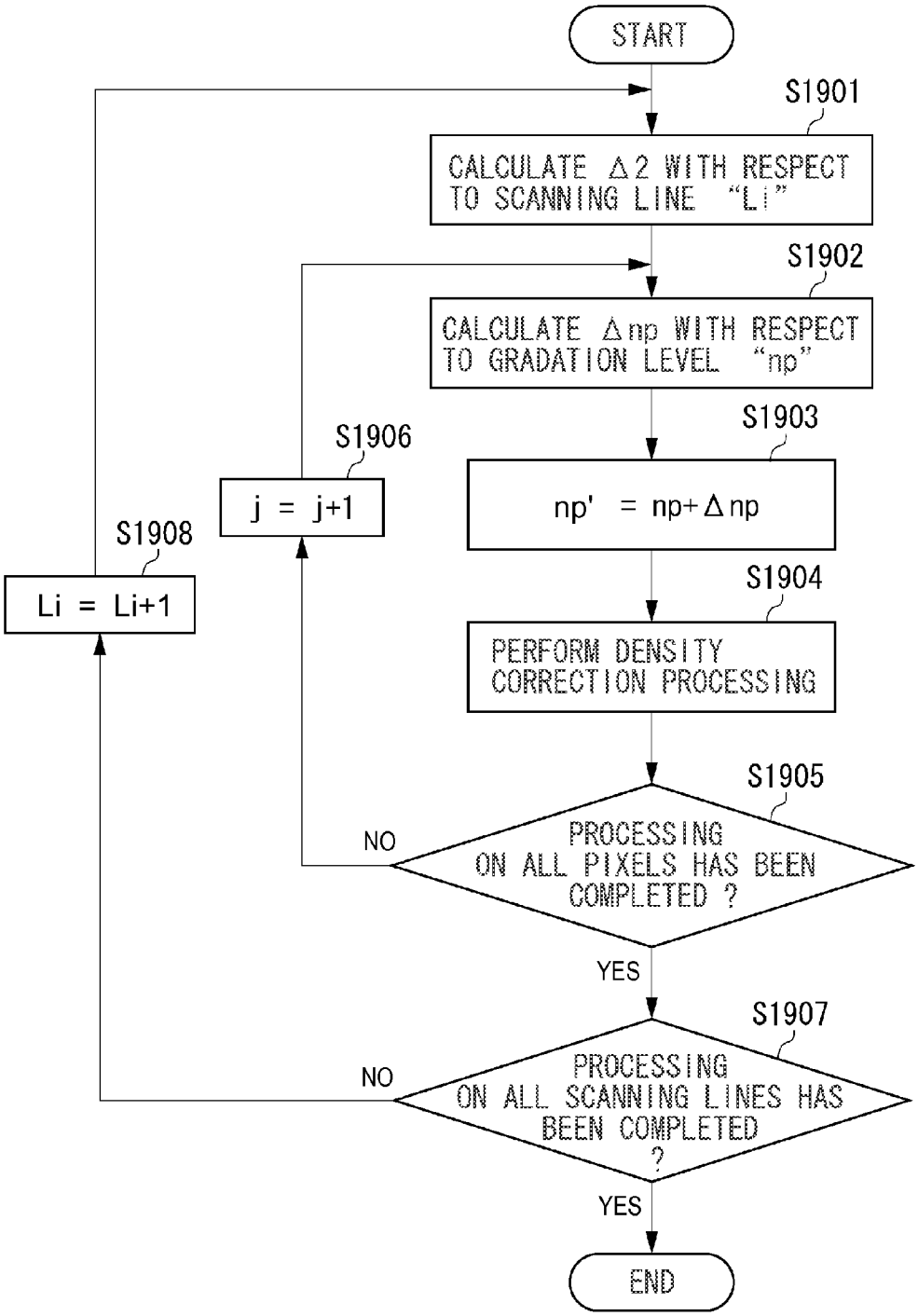
FIG. 19 illustrates a flowchart of an exemplary embodiment of the density correction processing when the printing is performed.

FIG. 19 illustrates a flow of the density correction processing of the present exemplary embodiment. The CPU 137 performs the processing in each step illustrated in FIG. 19 except for step S1904. Firstly, in step S1901, the CPU 137 acquires Δ2 of the scanning line Li by the similar procedure to that in the second exemplary embodiment. Similar to the relationship between the uneven density and the image density in the second exemplary embodiment, the relationship between the uneven density and the image density has the characteristics illustrated in FIG. 18 and can be expressed by Equation (13).

$$\Delta d=-a\times k^2+a\times(Y-k)^2=a\times(Y^2-2\times Y\times k) \quad (13)$$

$$(k=Y4/2)$$

The processing is performed on each pixel of the scanning line Li. The processing to be performed on a $j^{th}$ pixel will be described. The gradation value of the $j^{th}$ pixel is defined as "np".

As described above in Equations (9) and (10), since Δ2=a×(Y2$^2$−2×Y2×k) is satisfied, a=Δ2/(Y2$^2$−2×Y2×k) can be also satisfied. Therefore, from Equation (13), the uneven density Δp for the gradation "np" and the density "Yp" can be acquired by Equation (14).

$$\Delta p=\Delta 2/(Y2^2-2\times Y2\times k)\times(Yp^2-2\times Yp\times k) \quad (14)$$

Equation 14 indicates the sequential uneven density (density change) for an arbitrary gradation "np" based on the sequential uneven density for a certain gradation "n2" acquired by detecting the patch. A correction amount Δnp for the gradation "np" can be acquired by Equation (15) as a correction value corresponding to a size of the density change.

$$\Delta np=-\Delta p/f \quad (15)$$

By Equation (15), the gradation value of the image can be corrected to cancel the uneven density Δp that appears on the toner image.

According to the correction table illustrated in FIG. 15, the intervals n0, n1, n2, n3, and n4 are the same as the intervals d0, d1, d2, d3, and d4 respectively. In other words, an amount of the density change can similarly correspond to the gradation change at any gradation. Accordingly, Δnp for canceling the uneven density Δp can be adopted as the correction value of the input gradation value as it is.

Since an equation Yp=f×np can be satisfied, in step S1902, Δnp can be acquired from the gradation "np" by Equation (16).

$$\Delta np=-\Delta 2/(Y2^2-2\times Y2\times k)\times((f\times np)^2-2\times f\times k\times np)/f \quad (16)$$

Δnp as the density correction information acquired in step S1902 is added to the gradation "np" by Equation (17), and in step S1903, "np'" is calculated as follows.

$$np'=np+\Delta np \quad (17)$$

In step S1904, the density correction processing unit 133 performs the density correction by the density correction table (image density conversion unit) in which the density characteristics 1401 illustrated in FIG. 15 is the reference density characteristics 601, and the reversed characteristics table 1402 illustrated in FIG. 15 is the reversed characteristics table 602 of the reference density characteristics 601.

In step S1905, the CPU 137 determines whether the processing is completed on all pixels. When the processing is not completed on all pixels (NO in step S1905), in step S1906, the pixel "j" is advanced by "1" and the processing on a next pixel is returned to step S1902.

When the processing is completed on all pixels (YES in step S1905), in step S1907, the CPU 137 determines whether the processing is completed on all scanning lines. When the processing is not completed on all scanning lines (No in step S1907), the scanning line Li is advanced by "1" in step S1908 and the processing on a next scanning line is returned to step S1901. When the density correction processing is completed on all scanning lines, the processing proceeds to step S1016.

The CPU 137 causes the scanning unit 24 to emit the light to form the images corresponding to all scanning lines on which the density correction is performed, and thus the banding can be decreased.

According to the present exemplary embodiment, the relationship between the density and the uneven density is defined by quadratic functions. However, the density unevenness of each scanning line may have a constant value for any density. In this case, since Δnp can be expressed by Equation (18) for any gradation, the processing can be performed at high speed.

$$\Delta np=-\Delta 2/f \quad (18)$$

Further, instead of the calculation performed by the CPU 137 as described in FIG. 19, for example, a table may be prepared by which an amount of the image correction can be specified from the gradation values and the values of the uneven densities. The table includes a vertical axis for indicating the gradation values (1 to 255) and a horizontal axis for indicating the uneven densities (Δp) within an estimated range. With this arrangement, the load of the CPU 137 for performing the processing can be decreased.

Each exemplary embodiment described above describes an example where the patch is formed on the intermediate transfer member 27. The patch may be also formed on the transfer material conveyance belt (on the transfer material bearing member). More specifically, each exemplary embodiment described above can be adopted by the image forming apparatus that adopts a primary transfer method for directly transferring the toner image developed on the photosensitive drum 22 onto the recording material.

In this case, the intermediate transfer member 27, which is a patch-forming target in the above-described exemplary embodiment, may be replaced with the transfer material conveyance belt (transfer material bearing member) for conveying the transfer material (recording material) on which the toner image developed on the photosensitive drum 22 is directly, primary transferred.

Further, as described above, the movement distance D_m to the scanning line Li is predetermined and the scanning unit 24 emits the light to the image corresponding to the scanning line Li according to the movement distance D_m. However, emission is not limited to the emission described above. In contrast, the scanning unit 24 may emit the light on the scanning line Li at an arbitrary timing, and the image density correction corresponding to the information of the movement distance D_m may be performed.

More specifically, the CPU 137 may measure the information about the distance that the rotation member has moved from the reference (e.g., timing when the exposure of the leading end of the patch "m" is started) and perform in real time the density correction corresponding to the measured movement distance right before the scanning unit 24 performs the exposure. In addition, information indicating the distance that the rotation member has moved corresponds to information about rotation amount which indicates a rotation amount of the rotation member.

By performing this processing, as with the exemplary embodiments described above, the scanning unit 24 performs the exposure in which the density correction processing is reflected according to the movement distance D_m. Further, according to the above embodiment, the density of the image information is changed. However, the density of the image, not the image information, may be corrected as a result by, for example, directly operating the PWM signal.

Further, according to each above-described exemplary embodiment, the reference is defined as the starting position/timing for exposing the leading end of the patch "m". However, a position/timing is not limited the position/timing described above.

Similar kinds of effects can be obtained by setting the reference to an arbitrary position/timing. In this case, Pd_m at Zd_m is defined as the distance ΔD_m from the position of the leading end of the patch "m" to a reference position, and Equation (19) can be satisfied.

$$Pd_m=\Delta D_m/Td*2+Pd_m \quad (19)$$

Equation (19) can be also applied to Pi_m and Ps_m.

Furthermore, in each above-described exemplary embodiment, the exemplary embodiment using the table type as illustrated in FIGS. 6 and 13 through 15 are described. However, a type is not limited to the table type described above. For example, an equation instead of the table maybe used to acquire an output value in response to an input value.

Alternatively, for example, Equation (4) may be used as a table in which the phase (e.g., information about a number of current point in 1,000 points (one revolution is divided into 1,000 points of 0 to 999)) corresponds to the density change. Based on the table, similar processing to that described above may be performed.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-149806 filed Jun. 24, 2009, and No. 2010-116395 filed May 20, 2010, which are hereby incorporated by reference herein in their entirety.

What is claimed is:

1. An image forming apparatus comprising:

an image forming unit including a rotation member configured to form an image;

a detection image forming unit configured to have the image forming unit form a detection image;

a detection unit configured to detect reflected light when the formed detection image is irradiated with light;

an acquisition unit configured to acquire information on a density change that periodically changes in a sub-scanning direction of the detection image caused by rotation of the rotation member, from results detected by the detection unit; and a correction unit configured to correct an image density based on a reference state in the acquired information on the density change that periodically changes and information on a rotation amount of the rotation member from a reference timing corresponding to the reference state.

2. The image forming apparatus according to claim 1, further comprising:

a measurement unit configured to measure the information on the rotation amount of the rotation member from the reference timing; and an exposure unit configured to perform exposure which reflects density correction processing corresponding to the measured rotation amount.

3. The image forming apparatus according to claim 1, wherein the correction unit further comprises an image density conversion unit configured to cancel image density according to information on the rotation amount corresponding to each scanning line, and wherein the correction unit corrects the image density by the image density conversion unit.

4. The image forming apparatus according to claim 3, wherein, from information on a density change at a certain gradation value based on results of detecting the detection image at the certain gradation value, information on a density change at another gradation value is calculated to generate the image density conversion unit.

5. The image forming apparatus according to claim 1, wherein the correction unit is configured to correct a gradation value of image information with a correction value corresponding to a size of the density change.

6. The image forming apparatus according to claim 1, wherein the reference state includes a phase of the density change that periodically changes.

7. The image forming apparatus according to claim 1, wherein the rotation member comprises at least one of a photosensitive drum, a development roller, a driving roller of an intermediate transfer member, and a transfer material bearing member.

8. An image forming apparatus comprising:

an image forming unit including a rotation member configured to form an image;

a detection image forming unit configured to have the image forming unit form a detection image; and a detection unit configured to detect reflected light when the formed detection image is irradiated with light, wherein first density correction information for correcting an image density is generated based on a result of detecting a first detection image composed of a plurality of different gradation values by the detection unit, the first density correction information is modified based on a result of detecting a second detection image composed of a plurality of gradation values for detecting an image density that periodically changes due to rotation of the rotation member by the detection unit so as to generate second density correction information for correcting an image density that periodically changes due to rotation of the rotation member, and an image density is corrected based on the second density correction information.

* * * * *